US008191294B2

(12) United States Patent
Lennard

(10) Patent No.: US 8,191,294 B2
(45) Date of Patent: Jun. 5, 2012

(54) FIXING DEVICE FOR A NOTICE BOARD

(76) Inventor: Patrick Nicholas Lennard, Aylesbury (GB)

( * ) Notice: Subject to any disclaimer, the term of this patent is extended or adjusted under 35 U.S.C. 154(b) by 0 days.

(21) Appl. No.: 12/998,735

(22) PCT Filed: Nov. 24, 2009

(86) PCT No.: PCT/GB2009/002732

§ 371 (c)(1),
(2), (4) Date: Jul. 26, 2011

(87) PCT Pub. No.: WO2010/061175

PCT Pub. Date: Jun. 3, 2010

(65) Prior Publication Data

US 2011/0271571 A1 Nov. 10, 2011

(30) Foreign Application Priority Data

Nov. 27, 2008 (GB) ..... 0821655.8

(51) Int. Cl.
*G09F 15/00* (2006.01)

(52) U.S. Cl. ..... 40/607.13; 40/611.12

(58) Field of Classification Search ..... 40/607.13, 40/607.14, 611.12
See application file for complete search history.

(56) References Cited

U.S. PATENT DOCUMENTS 2,262,873 A 11/1941 Wise
7,001,096 B2 * 2/2006 With ..... 402/60

FOREIGN PATENT DOCUMENTS

DE 44 38 928 11/1995
NL 1 015 776 1/2002

* cited by examiner

*Primary Examiner* — Casandra Davis
(74) *Attorney, Agent, or Firm* — Merek, Blackmon & Voorhees, LLC

(57) ABSTRACT

A fixing device (11) for use with a notice board (33) having at least two spaced fixing holes (33) formed in the board, and comprising two pieces (12,13) for placement one either side of the board (33) each with a respective front face (15 or 17) which sits against the board (33), one piece (12) having spaced apart studs (18) thereon which in use pass through the fixing holes (33) to engage in retention holes (28) in the other piece (13), one of said two pieces (13) having a rear face (14) with attachment means (16) for attaching the device (11) to a support (31) and a resiliently flexible projection (27) which is engagable with surfaces on the support (31).

14 Claims, 5 Drawing Sheets

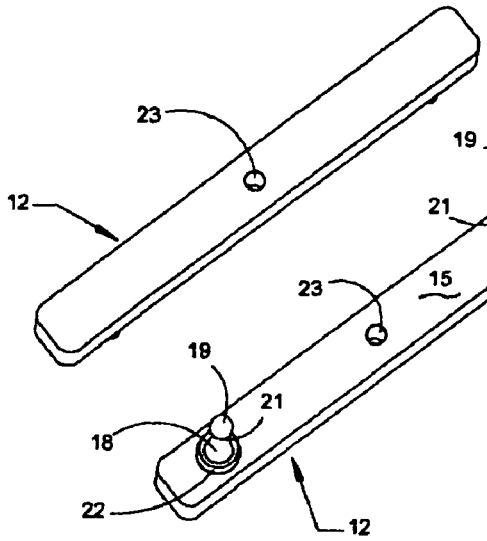
Fig 2
Fig 3
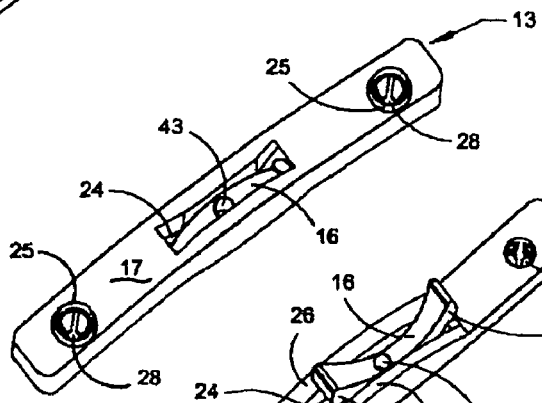
Fig 4
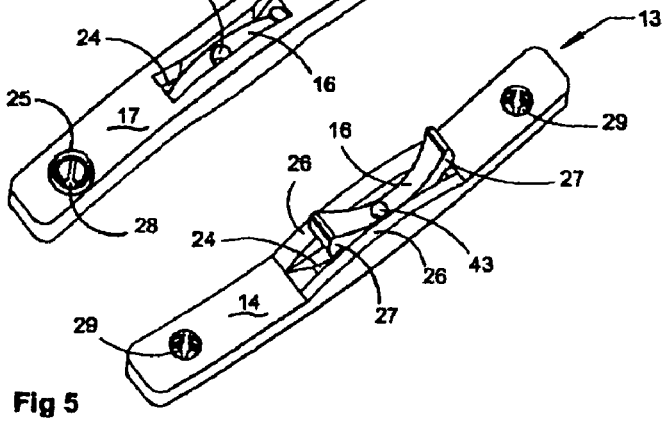
Fig 5
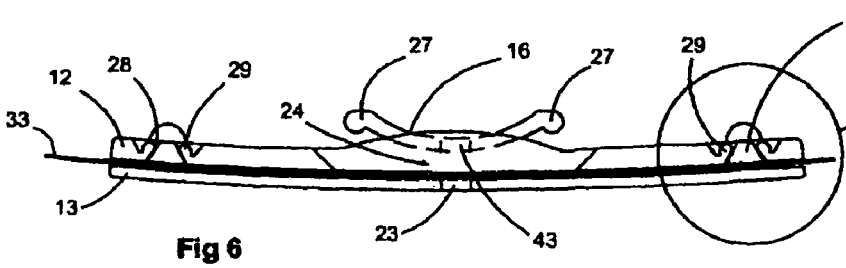
Fig 6
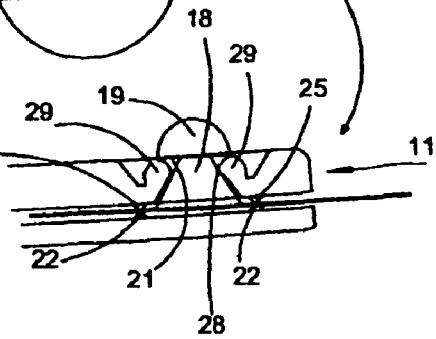
Fig 7

FIXING DEVICE FOR A NOTICE BOARD

CROSS-REFERENCE TO RELATED APPLICATION

The present application claims the priority under 35 U.S.C. 119 of United Kingdom Patent Application No. 0821655.8, filed Nov. 27, 2008, which is hereby incorporated herein by reference in its entirety.

FIELD

This invention relates to a fixing device for use in the attachment of a notice to a support for display.

BACKGROUND OF THE INVENTION

Public notices are typically displayed on street furniture, for example telegraph poles, lamp stands, traffic sign post etc. or on trees, or walls, and are typically nailed, pinned, pasted or tied in place. Frequently it is desired to protect the notice from the weather and sometimes the notices are enclosed in transparent plastics bags or may be laminated within plastics covers. The use of nails or pins to secure such notices in position will breach the integrity of the protection.

Another form of notice in common use comprises a sheet of rigid plastics material, usually a light weight twin flute board material sold under the name Corex™. The information may be printed directly onto the plastic board.

These notices are generally of a temporary nature and it is an advantage if the notice can be displayed in a manner which makes it easy to remove without trace, or damage. A known mounting device which adheres to the back of a notice is disclosed in GB2364 736.

In an alternative method, both the Corex type notice board and laminated notice board are frequently provided with holes which are punched through the notice board and which permit the use of a tie for holding the board to a support. These holes provide stress raisers in the boards and the notice boards have poor durability due to tears caused by the cutting action of the tie especially in high winds.

Furthermore, the ties, when pulled tight also cause the notice to follow the profile of the support, so that frequently the notice board is curved and difficult to read and is under inherent stress which also causes tears. On the other hand if the ties are too loose the notice falls to the ground or is blown around in the wind.

When holes are punched through laminated notice boards the holes typically destroy the water seal allowing water penetration which frequently renders the notice unreadable.

OBJECT OF THE INVENTION

The present invention provides a device for attaching a notice board having fixing holes for ties for mounting to a support using ties or other means.

STATEMENTS OF INVENTION

According to a first aspect of the present invention there is provided a fixing device for use with a notice board having at least two spaced fixing holes for ties, the fixing device comprising two pieces for placement one on each side of the board, each piece having a body with a front face which in use sits against one side of the board, one piece having at least two spaced apart studs thereon which in use pass through respective fixing holes and engage in retention holes in the other piece, one of said two bodies having a rear face with at least one resiliently flexible projection thereon which in use is engagable with a surface on a support to which the notice may be mounted, and has attachment means whereby the fixing device is attached to the support.

The attachment means may comprise said resilient flexible projection on the rear face with at least one longitudinal passageway provided at the base thereof through which a tie can slidingly pass. The ties are preferably plastics straps, typically made from nylon, having serrations thereon engagable in a detent formed on one end of the strap.

Preferably the projection(s) may comprise a first pair of oppositely extending inclined flexible wings extending longitudinally of the respective body. The wings may be inclined at between 10-30 degrees from the body so that in use the wings may deflect on engagement with a surface on the support. The wings may be deflected by the ties into contact with the support. The two wings also provide a cleat around which a cord or string may tied when the notice board is secured to a support.

The attachment means may comprise at least one fastener hole provided by aligned holes in both bodies to accommodate passage of a screw, nail, pin, or tack for securing the board to a suitable post or surface. In the case of a single fastener hole the two aligned holes in the two bodies are centrally located. Where the attachment means also comprises a projection on the rear face the fastener hole may pass through the projection.

The studs are held in the respective retention holes by clip means formed integrally with the respective body within each retention hole. Each clip means comprises a resilient frustoconical detent formed within the respective hole and tapering away from the respective front face, the detent flexing to allow passage of a respective head of a stud and engaging undercuts formed on said head.

The front face of each piece may be provided with sealing rings surrounding the respective stud or retention hole, the sealing rings in use sealing against a board surface.

Preferably the attachment means are formed on said other piece and are located centrally of the body between two retention holes.

The studs may be provided with pointed heads to facilitate driving the studs through a board for the formation of fixing holes in the board. In which case, the other piece may have a raised ring surrounding the retention hole on the side away from the board, the ring in use being higher than the stud head retained in said retention hole.

The two elongate pieces may be substantially flat or may be curved longitudinally.

The front face of at least one of said two pieces is provided with spikes thereon for engaging the surface of board.

According to yet another aspect of the Invention there is provided a notice board comprising a sheet or board having at least two fixing holes therein and at least one fixing device according to the first aspect of the present invention attached to the board via the fixing holes. The fixing holes may be pre-formed holes, typically punched holes, or may be formed when the studs on the fixing device are punched through the sheet or board.

DESCRIPTION OF THE DRAWINGS

The invention will be described by way of example and with reference to the accompanying drawings in which:

FIG. 2 is an isometric view of one piece of the fixing device of FIG. 1 from the rear, FIG. 3 is an isometric view of said one piece of the fixing device of FIG. 1 from the front, FIG. 4 is an isometric view of the other piece of the fixing device of FIG. 1 from the front, FIG. 5 is an isometric view of the other piece of the fixing device of FIG. 1 from the rear, FIG. 6 is a longitudinal section through the fixing device and notice board of FIG. 1, FIG. 7 is an enlarged detail from FIG. 6.

DETAILED DESCRIPTION OF THE INVENTION

Figure 1:
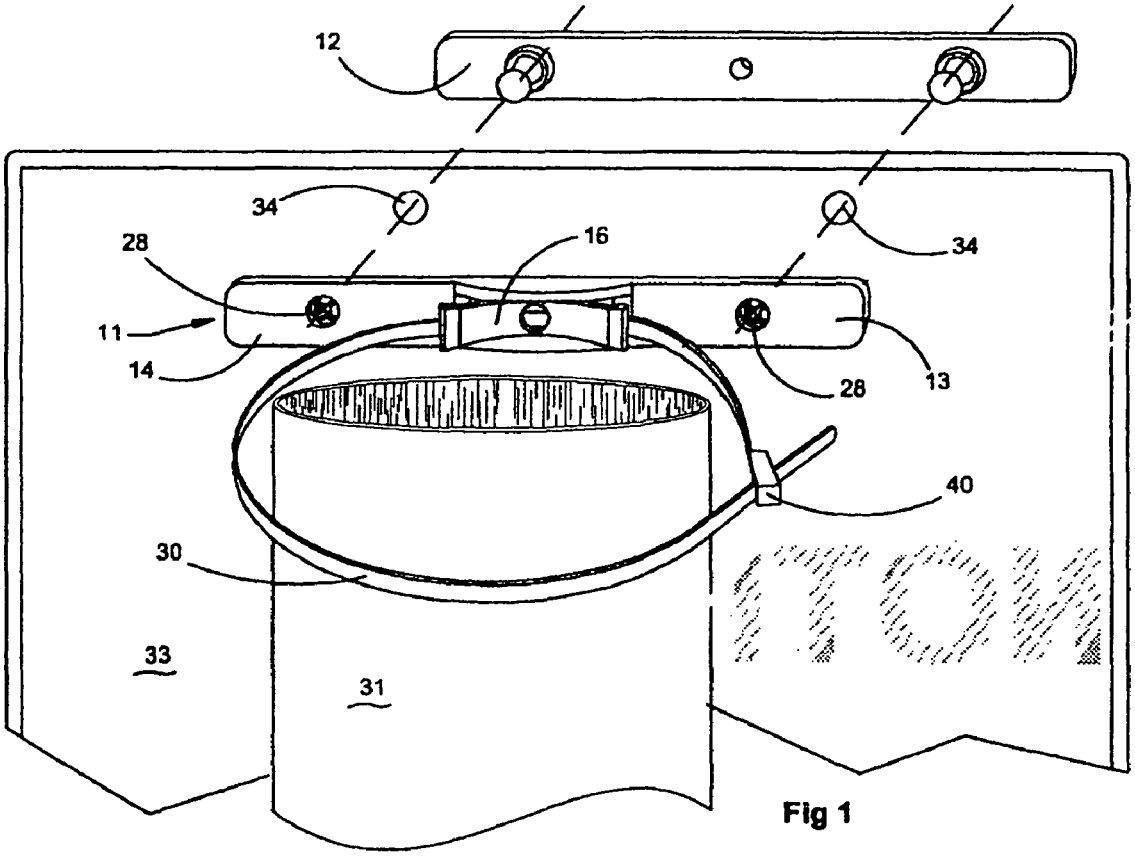
FIG. 1 is an isometric exploded view of a fixing device according to the present invention in assembly with a notice board and support.
Figure 10:
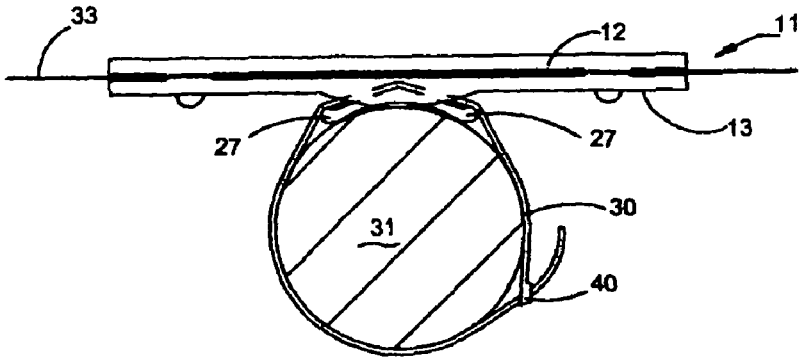

With reference to FIG. 1, and FIG. 10, there is shown a fixing device 11 attached to a notice board 33 having a pair of spaced apart fixing holes 34 preformed therein. The fixing holes may be provided in both the top and bottom portions of the board 33 as required. The notice board 33 typically comprises a sheet of paper laminated between two plastic sheets. The, or each, fixing device comprises two elongate pieces 12, 13 for placement one on each side of the board 33. The two pieces 12,13 are interconnected through the fixing holes 34 and rear face 14 of the piece 13 has an attachment means 16 whereby the fixing device 11 is mounted to a post 31. In this example the fixing device 11 is shown in use with a nylon tie 30 which is pulled tight around the post 31.

Now with reference also to FIGS. 2 and 3, one piece 12 has a longitudinally extending body with a substantially flat front face 15 which in use sits against one side of the board 33. Said one piece 12 has at least two spaced apart studs 18 thereon which in use pass through respective fixing holes 34 and engage in retention holes 28 in the other piece 13. The studs 18 each have a head 19 with undercuts 21 formed thereon. The base of each stud is surrounded by an upstanding sealing ring 22. A hole 23 for a fastener is provided at a substantially central location in the piece 12.

Referring also to FIGS. 4 and 5, the other piece 13 also has a longitudinally extending body 13 with a flat face 17 which in use sits against the opposite side of the board 33 to said one piece 12. Said other piece 13 is provided with spaced apart retention holes 28 which align with the fixing holes 34 in the board 33 and the studs 18 on said one piece 12. The front face 17 has an upstanding sealing ring 25 surrounding each retention hole 28. Each retention hole 28 houses a clip means 29 formed integrally with the respective body within each retention hole 28. Each clip means comprises a resilient frusto-conical detent which tapers away from the respective front face 17 towards the rear face 14. The detent flexes to allow passage of a respective head 19 of a stud 18 and engages undercuts 21 formed on said head 19.

The rear face 14 of said other piece 13 has two longitudinally extending side walls 26 one on each side thereof. The sidewalls 26 are inclined from a minimum height at each end of the piece to maximum height at the centre, where the attachment means 16 is located between the two side walls 26. The two side walls 26 act as buttresses to prevent bending of said other piece. The walls 26 form at their centres a raised base for the attachment means 16. The attachment means 16 comprises a resilient flexible projection with a pair of oppositely extending wings 27 extending longitudinally between the side walls 26. The two wings 27 are inclined upwardly away from the rear face 14 at an angle of between 10-30 degrees. A longitudinal passageway 24 is provided on the underside of the attachment means 16 and opens to the front face 17. The passageway 24 can in use accommodate a tie in the form of string, cord or nylon tie 30 as shown. A fastener hole 43 is formed in the attachment means 16 and in use aligns with the fastener hole 23 in the said one piece 12. The two aligned faster holes 23,43 accommodate passage of a screw, nail, pin, or tack for securing the board to a suitable post or surface.

With reference now to FIG. 6 and FIG. 7, there is shown the two pieces 12 & 13 of the fixing device 11 assembled either side of a notice board 33. The studs 18 of said one piece 12 are inserted through the fixing holes 34 in the board 33 and the other piece 13 is clipped in place by passing the retaining holes 28 over the studs 18 until the heads 19 of the studs pass through the clip means 29 which engage the detents 21 behind the stud heads 19. The sealing rings 22 and 25 on the pieces 12 & 13 engage the board 33 to seal around the fixing holes 34 to prevent the ingress of water.

The resiliently flexible wings 27 of the attachment means 16 in use contact surfaces on the support 31 to which the notice may be fixed, and the tie 30 presses the resilient wings 27 onto a surface of a support 31 e.g. a post. The inherent spring load in the resilient wings 27 increases the frictional grip of the fixing device 11 against the post 31.

The tie 30 preferably comprises a serrated nylon strap which is slidably held in the passageways 24 on the rear face 14 of said other piece 13. The ties 30 are typically provided with a detent 40 at one end, and which is preferably releasable.

Figure 9:
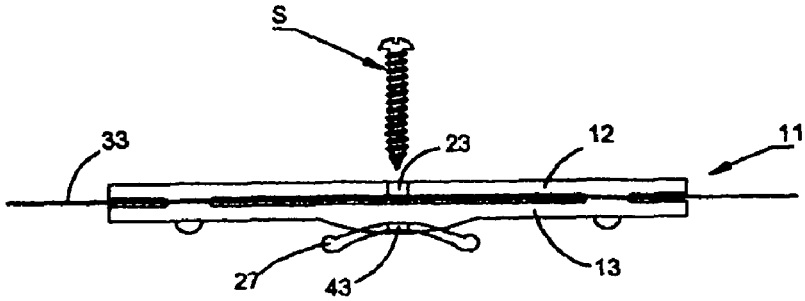
FIGS. 9-11 show alternative ways of mounting the fixing devices to a support

If the notice board is mounted to a wooden support e.g. wooden surface or post, then fixing device 11 may alternatively be secured in place by a screw S or other suitable means passing through the fastener holes 23,43 in the two clipped together pieces 12 & 13, as shown in FIG. 9.

Figure 11:
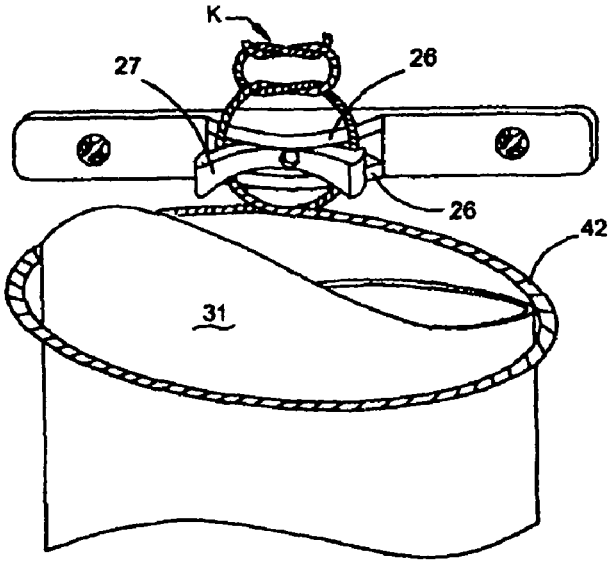

FIG. 11 shows yet another fixing arrangement in which a cord or string 42 is passed around a post 31 and is tied around the wings 27 of the attachment device. The wings 27 act as a cleat allowing the cord to be tightened around the post and jammed between the wings 27 and side wall 26 without loss of tension before forming a knot K.

Figure 12:
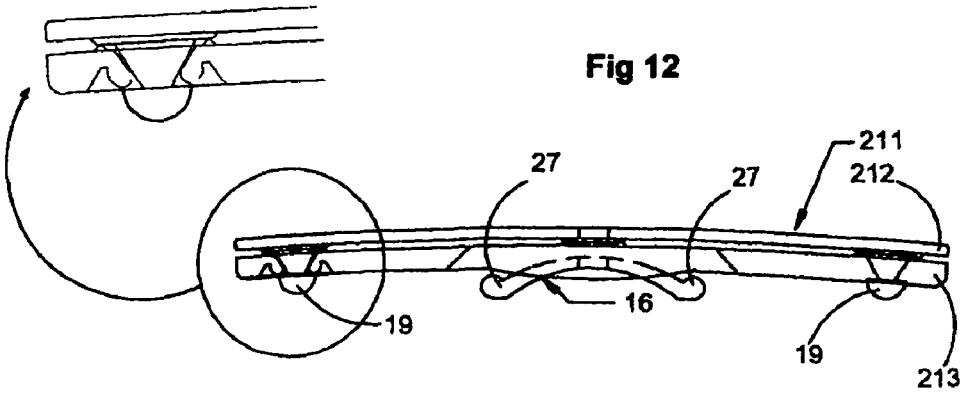
FIG. 12 is a side view through another embodiment.
Figure 13:
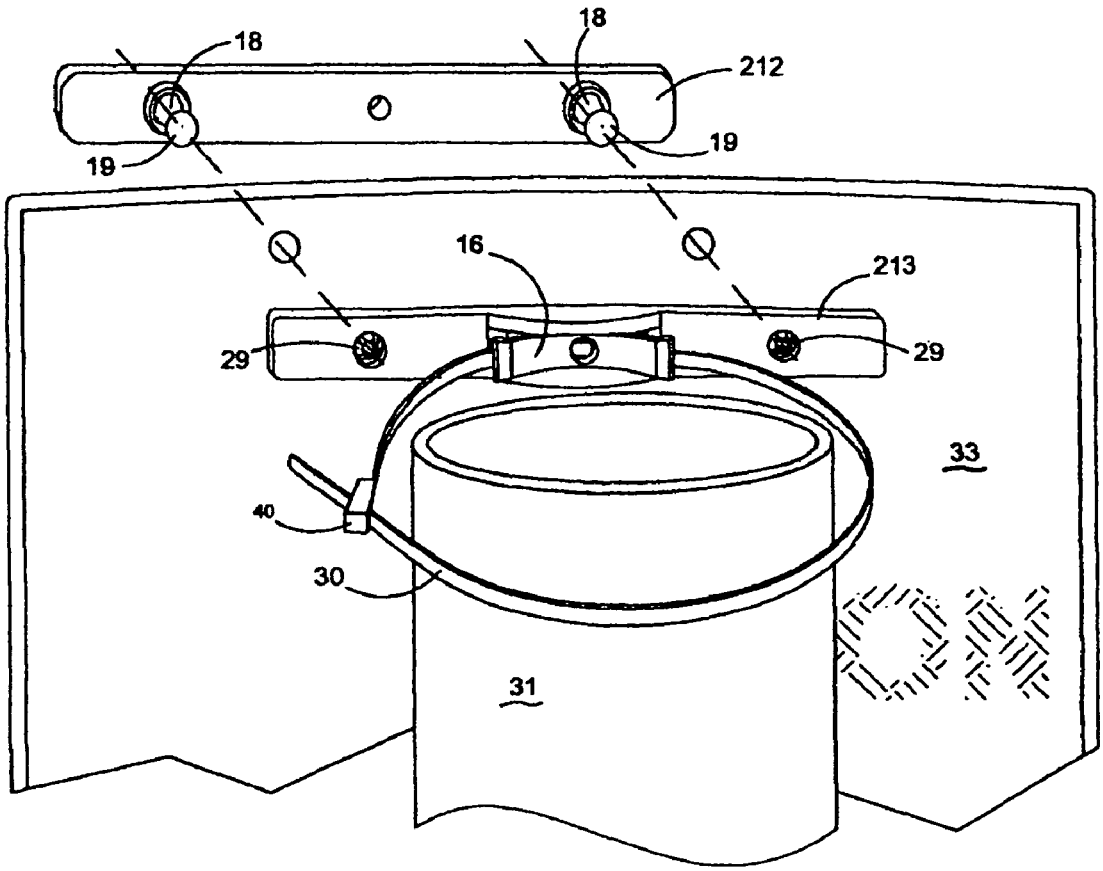
FIG. 13 is an isometric exploded view of the fixing device shown in FIG. 12 in assembly with a notice board and support.
Figure 14:
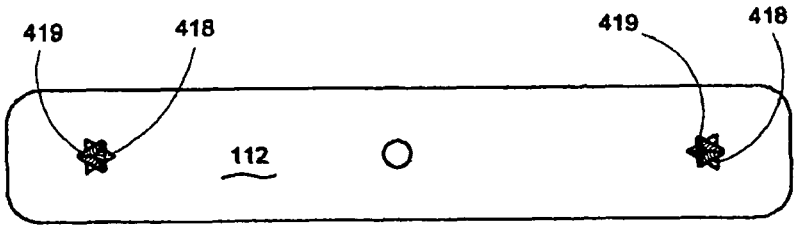
FIG. 14 is a front view of one piece of another fixing device according to the invention.
Figure 15:
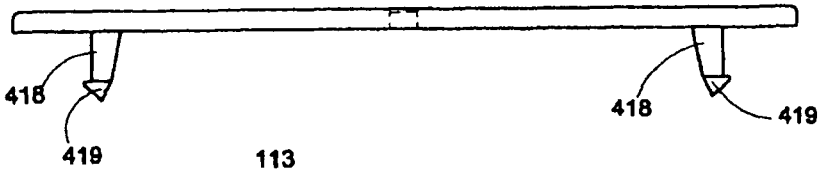
FIG. 15 is a side view of said one piece of the fixing device shown in FIG. 14.
Figure 16:
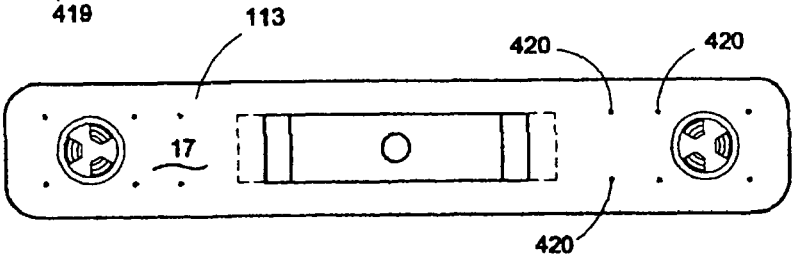
FIG. 16 is a front view of the other piece of the other fixing device.
Figure 17:
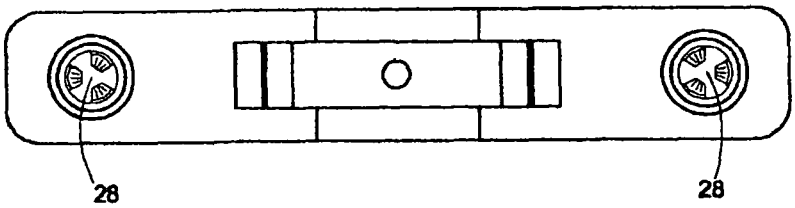
FIG. 17 is a rear view of the other piece of the fixing device of FIG. 16.
Figure 18:
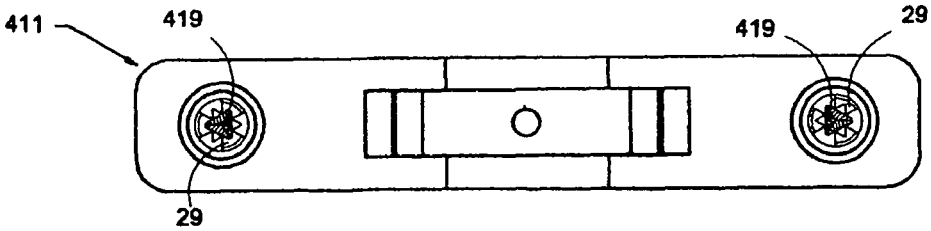
FIG. 18 is a rear view of the two pieces in FIGS. 14-17 in assembly.
Figure 19:
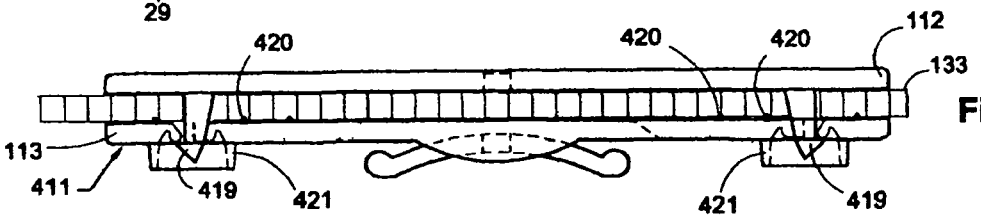
FIG. 19 is a side view in part section of the assembled device shown in FIG. 18 in situ with a notice board.

Referring now to FIGS. 12 & 13, there is shown another embodiment of the invention which is similar to that shown with reference to FIGS. 1 to 7, and the same reference numbers will be used for the same components. The main difference is that the fixing device 211 comprises two pieces 212, 213 which are slightly curved longitudinally so as to hold the board 33 in a curved condition around the post 31. This helps stiffen the notice board.

Figure 8:
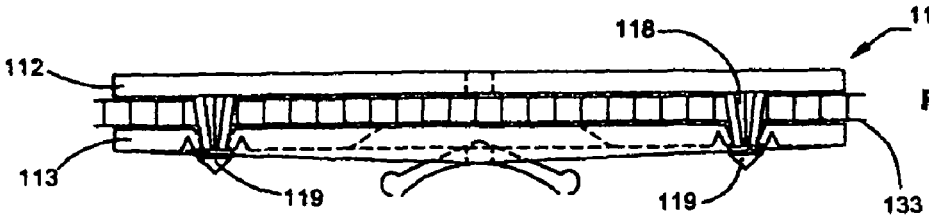
FIG. 8 is a longitudinal section through a second fixing device according to the invention.

Another embodiment of the invention is shown in FIG. 8. in which the notice board 133 comprises a sheet of a light weight twin flute board material sold under the name Corex™. The fixing holes may be pre-formed in the board 133, as before. The fixing device 111 is substantially identical to the fixing device 11 as previously described and where appropriate the same reference numbers will be used. The major difference is that the front faces 15 and 17 of the two pieces 112,113 are formed WITHOUT sealing rings 22 and 25 around the studs 118 and retaining holes 28. The head 119 of each stud 118 is pointed allowing the studs to be, driven or punched through some board materials e.g. the Corex™ board. The sides of studs 118 are also fluted to aid the cutting action through the material.

Another embodiment of a fixing device 411 is shown in FIGS. 14-19, and is substantially identical to the fixing device 111 as previously described and where appropriate the same reference numbers will be used. The major differences are that said one piece 112 is provided with studs 418 which are triangular in section having prismoidal shaped head 419 offset from the stud.

The other piece 113 has on its front face a plurality of spaced apart raised spikes 420 which in use will either penetrate or grip the Corex sheet 133. The retaining holes 28 are surrounded on their face away from the board 133 by a raised ring 421 which in use sits above the pointed head 419 of the stud to protect the a user from the head when it pierces the board.

The devices 11 & 111 together with ties 30, screws and string, may form a kit for mounting a notice board for display.

The invention claimed is:

1. A fixing device for use with a notice board having at least two spaced fixing holes formed therein, the fixing device comprising two pieces for placement one on each side of the board, each piece having a body with a front face which sits against one side of the board, one piece having at least two spaced apart studs thereon which in use pass through respective fixing holes and engage in retention holes in the other piece, one of said two bodies having a rear face with attachment means thereon for attaching the device to a support and a resiliently flexible projection which is engagable with surfaces on the support, the studs being held in the respective retention holes by clip means formed integrally with the body of said other piece.

2. A fixing device as claimed in claim 1, wherein the attachment means comprise said resilient flexible projection mounted on a raised base on said rear face and at least one longitudinal passageway provided underneath the base to accommodate a tie.

3. A fixing device as claimed in claim 2, wherein the projection comprises a first pair of oppositely extending inclined flexible wings extending longitudinally of the respective body.

4. A fixing device as claimed in claim 3 wherein the wings are inclined at between 10-30 degrees from the body away from a raised base formed on the rear surface of the body.

5. A fixing device as claimed in claim 1, wherein the attachment means comprise at least one fastener hole provided by aligned holes in both bodies to accommodate passage of a screw, nail, pin, or tack for securing the board to a suitable post or surface.

6. A fixing device as claimed in claim 5, said fastener hole passing through the resilient projection.

7. A fixing device as claimed in claim 1, wherein each clip means comprises a resilient frustoconical detent formed in the respective hole and tapering away from the respective front face, the detent flexing to allow passage of a respective head of a stud and engaging undercuts formed on said head.

8. A fixing device as claimed in claim 1, wherein the studs have pointed heads to facilitate driving the studs through a board for the formation of fixing holes in the board.

9. A fixing device as claimed in claim 8, wherein said other piece has a raised ring surrounding the retention hole on the side away from the board, the ring in use being higher than the stud head retained in said retention hole.

10. A fixing device as claimed in claim 1, wherein the front face of each piece may be provided with sealing rings surrounding the respective stud or retention hole, the sealing rings in use sealing against a board surface.

11. A fixing device as claimed in claim 1, wherein the attachment means are formed on said other piece and are located centrally of the body between two retention holes.

12. A fixing device as claimed in claim 1, wherein the two elongate pieces are curved longitudinally.

13. A fixing device as claimed in claim 1, wherein the front face of at least one of said two pieces is provided with spikes thereon for engaging the surface of a board.

14. A notice board comprising a sheet or board having at least two fixing holes therein and at least one fixing device according to claim 1.

* * * * *